US005494634A

United States Patent [19]

Edelstein et al.

[11] Patent Number: 5,494,634

[45] Date of Patent: Feb. 27, 1996

[54] MODIFIED CARBON FOR IMPROVED CORROSION RESISTANCE

[75] Inventors: Alan S. Edelstein; Richard K. Everett, both of Alexandria; Patricia P. Trzaskoma, Falls Church, all of Va.; Benji Maruyama, Dayton, Ohio

[73] Assignee: The United States of America as represented by the Secretary of the Navy, Washington, D.C.

[21] Appl. No.: 4,002

[22] Filed: Jan. 15, 1993

[51] Int. Cl.[6] ..... B22F 1/00

[52] U.S. Cl. ..... 419/12; 419/6; 419/24; 419/31; 419/34; 264/DIG. 36

[58] Field of Search ..... 419/12, 6, 24, 419/31, 34, 36–37; 264/DIG. 36

[56] References Cited

U.S. PATENT DOCUMENTS

| | | | |
|---|---|---|---|
| 4,502,092 | 2/1985 | Bannink, Jr. et al. | 361/218 |
| 4,515,866 | 5/1985 | Okamoto et al. | 428/614 |
| 4,544,610 | 10/1985 | Okamoto et al. | 428/611 |
| 4,565,649 | 1/1986 | Vogel | 252/503 |
| 4,597,792 | 7/1986 | Webster | 75/249 |
| 4,680,093 | 7/1987 | Morin | 204/28 |
| 4,799,957 | 1/1989 | Vogel | 75/243 |
| 5,093,054 | 3/1992 | Hirota | 264/45.1 |

OTHER PUBLICATIONS

Trzaskoma et al., "Electrochemical Properties of $NiCl_2$ –Intercalated and Reduced–Ni $Cl_2$ –Intercalated Graphite," J. Electrochem. Soc., 140(6), L103–L106, Jun. 1993.

Yazami, "New Chemical Reduction of Transition Metal Chloride–Graphite Intercalation compounds with n–butyllithium," Synth. Met., 20(3), 383–386, 1987.

Vol'Pin et al., "Reduction of Intercalation Graphite," Zh. Obshch. Khim., 41(1), 242, 1971.

Vol'Pin et al., "Reduction of Graphite Intercalation compounds with transition metal chlorides," Izv. Akad. Nauk SSSR, Ser. Kim., (11), 2608–2609, 1970.

Sharma et al., "Ferromagnetic resonance study of reduced $NiCi_2$ graphite intercalation compound," Synthetic Metals, vol. 11, No. 1, 1–8, 1985.

Dutta et al., "Corrosion Behavior of a P130x Graphite Fiber Reinforce 6063 Aluminum composite Laminate in Aqueous Environments," J. Electro chem. Soc., vol. 138, No. 11, Nov. 1991, pp. 3199–3209.

Saxena et al., "Corrosion Characteristics of Aluminum Alloy Graphite Particulate Composite in Various Environments," J. of Materials Science 27 (1992) pp. 4805–4812.

Ohira et al., "Energy Dispersive X–Ray Analysis on Supported Metallic Clusters Generated by Redox Processes on Graphite Intercalation Compounds," Carbon, vol. 29, No. 8, 1991, pp. 1233–1238.

Callstrom et al., "Doped Glassy Carbon Materials (DGC): Low–Temperature Systhesis, Structure, and Catalytic Behavior," J. Am. Chem. Soc., 1990, 112, pp. 4954–5956.

Jones et al., "Environmental Effects on Advanced Materials," Journal of Metals, vol. 40, No. 12, Dec. 1988, pp. 18–30.

(List continued on next page.)

*Primary Examiner*—Donald P. Walsh
*Assistant Examiner*—Anthony R. Chi
*Attorney, Agent, or Firm*—Thomas E. McDonnell; Barry A. Edelberg

[57] ABSTRACT

Graphite or carbon particles with a graphitic skin are intercalated with a compound including an oxidized form of a metal and then reduced in a hydrogen atmosphere. This process reduces the driving force for the galvanic reaction between the particles and active metals in aqueous environments. The particles may be present as a reinforcement for a metal matrix (e.g., graphite/aluminum metal matrix composites) or as a reinforcement for a non-metallic material (e.g., graphite/polyimide, graphite/polyester or graphite/cyanate composites). In the latter case, the composite is adjacent to a metal in a structure.

By way of example, the graphite or carbon particle may be a fiber, the metal subject to attack may be aluminum or magnesium, and the intercalation compound may be $NiCl_2$.

11 Claims, 1 Drawing Sheet

OTHER PUBLICATIONS

Dull et al., "Final Report The Effect of Matrix and Fiber Composition on Mechanical Strength and Corrosion Behavior of Graphite–Aluminum Composites," Aerospace Report No. ATR–76(7564)–1, Jan. 15, 1977.

Trzaskoma, "Corrosion," Academic Press, Inc., 1991, pp. 383–404.

Trzaskoma, "Localized Corrosion of Metal Matrix Composites," The Minerals, Metals & Materials Society, 1991, pp. 249–265.

Bhagat et al., "Squeeze Cast Metal Matrix Composites: Evaluation of Their Strength, Damping Capacity and Corrosion Resistance," J. of Composite Materials, vol. 23, Sep. 1989, pp. 961–975.

Boyd, "The Effect of Galvanic Attack on Composities," Materials & Processing Report An International Technical Bulletin, vol. 6, No. 4/5, Jul./Aug. 1991, ISSN 0887–1949, pp. 1–2.

MODIFIED CARBON FOR IMPROVED CORROSION RESISTANCE

BACKGROUND OF THE INVENTION

1. Field of the Invention

The present invention relates to reinforced composites and more particularly to composites reinforced by carbon or graphite that has been treated to reduce corrosion between the reinforcement material and adjacent metals.

2. Description of the Background Art

It is well known that the corrosion performance of carbon fiber/aluminum (or magnesium) metal matrix composites is extremely poor in aqueous chloride environments. For example, the corrosion rate of a carbon fiber/aluminum alloy matrix composite is fifteen times greater than that of the non-reinforced alloy in 3.5 weight percent NaCl solution. The corrosion attack occurs as severe exfoliation and general deterioration near diffusion-bonded areas and at the carbon-aluminum interphase. This deterioration is more prominent near crevices, cracks or voids.

Three possible mechanisms can contribute to the accelerated corrosion of carbon fiber/aluminum metal matrix composites. They are: (1) crevice corrosion at voids formed between the fiber and matrix during fabrication, (2) preferential dissolution of interphase metal carbides which leads to the breakdown of aluminum's passivating oxide layer, and (3) galvanic corrosion at exposed surfaces. Because of the large potential difference between graphite and aluminum (1.2 V as determined from experimental data in seawater), many investigators have suggested that galvanic corrosion is the dominant mechanism.

Several others have attempted to overcome the corrosion susceptibility of carbon fiber/aluminum metal matrix composites. In one approach, the carbon or graphite reinforcement fibers are coated with a metal which reduces the galvanic interaction between the metal matrix and the fibers. In U.S. Pat. No. 4,680,093, a metal, such as nickel, is electroplated onto the surface of a carbon fiber which is then used to reinforce a matrix of a different metal. A similar approach is described in U.S. Pat. No. 3,622,283. In these approaches, where the carbon or graphite fiber is coated with a metal prior to incorporation into a matrix of another metal, a problem is that some of the advantages of the graphite/metal interface are lost. Additionally, typical methods of coating, such as electrodeposition, present contamination problems.

Similar corrosion problems also arise in structures where metallic members, which may be susceptable to galvanic corrosion, are in the presence of graphite or carbon-reinforced composites.

SUMMARY OF THE INVENTION

Accordingly, it is an object of this invention to improve the corrosion-resistance of structures containing carbon/graphite-metal interfaces.

It is another object of the present invention to modify carbon/graphite "particles" in a manner which reduces the galvanic interaction of the particles with a metal in a saline environment. The term "particle" is defined below.

It is a further object of the present invention to reduce the galvanic interaction between carbon/graphite particles in metal matrix composites while essentially maintaining the metal-carbon/graphite interface between the matrix and the particles.

These and additional objects of the invention are accomplished by intercalating a compound which includes a metal ion into a carbon/graphite particle, and then reducing the intercalated compound. The intercalated graphite/carbon particles are then incorporated into a matrix.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements, wherein.

DESCRIPTION OF THE PREFERRED EMBODIMENTS

Figure 1:
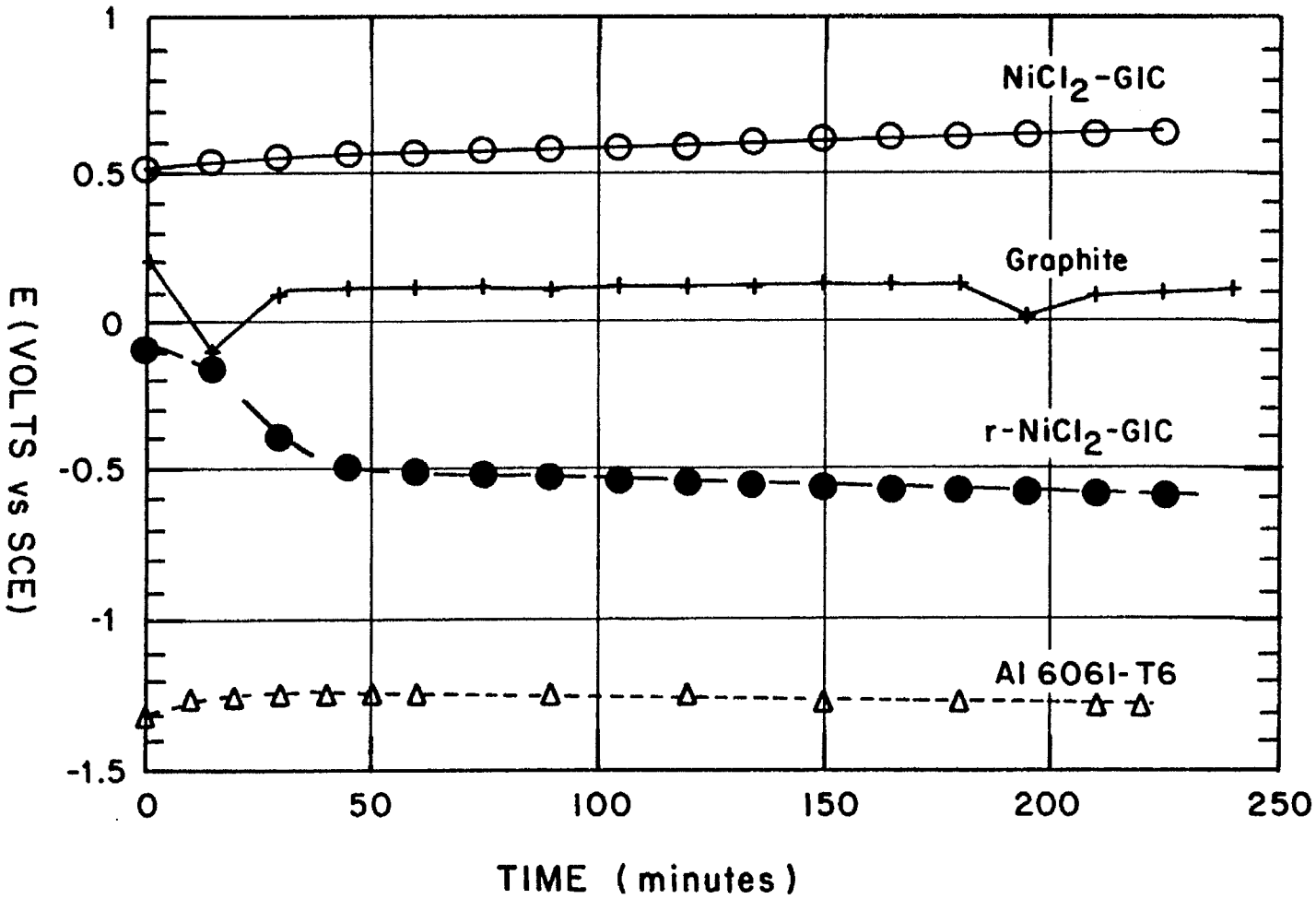
FIG. 1 shows the potential-time behavior of Al-6061-T6, graphite, $NiCl_2$-GIC, and r-$NiCl_2$-GIC.

The term "particle" applies to an inclusion of unspecified geometry within a matrix. A "filament" is filamentous but may have other than the standard cylindrical cross-section, such as star-shaped or polygonal. The term "filament" is generic to a particle of a large aspect ratio (colloquially referred to as hair-like) and includes fibers and whiskers. Fibers may be thought of as continuous in one dimension. Whiskers are single crystals. Obviously, there is no exact dividing line between fibers and whiskers, and some particles could perhaps be classified as either.

In metal matrix composites, the metallic matrix is a metallic material susceptible to galvanic corrosion in the presence of graphite or carbon. In structures where the metallic members susceptible to galvanic corrosion are adjacent to graphite or carbon-reinforced composites, matrix material of the composite may be any material (including a non-metallic material, such as a polymeric material) which may be reinforced with carbon or graphite.

The particles of the present invention (typically ranging in diameter from about 1 μm to about 50 μm can be consolidated with the matrix metal by any of the standard composites techniques, and are present in a volume percent sufficient to significantly enhance the thermal, electrical, tribological, mechanical or acoustic properties of the matrix. Generally, this amount corresponds to normal loading fractions, typically about 10 to 60 volume percent, but the composite can have a loading fraction of as little as about 0.1 volume percent of the particles. Usually, the loading fraction is at least 1 volume percent.

The graphite/carbon particle to be treated according to the invention should have a graphitic, or at least a partially graphitic, skin to permit intercalation. As used throughout the remainder of the specification and claims, a "graphite particle" is a particle of carbon or graphite which has an at least partially graphitic surface or skin that permits the required intercalation (i.e., the skin is sufficiently graphitic to permit intercalation to the extent needed to achieve desired corrosion resistance. The particles which are to be treated according to the present invention may be made by a variety of well-known and conventional techniques which are beyond the scope of this invention and will not be addressed herein. An "unmodified graphite particle" is a graphite particle which has not yet been intercalated according to the present invention.

The intercalant should be selected so that, after reduction, the graphite particle has a half-cell potential ($\mathcal{E}^\circ$) between that of the unmodified graphite particle and that of any adjacent metal. Preferably, the graphite particle containing the reduced intercalant has an $\mathcal{E}^\circ$ as close as possible to that of the adjacent metal.

Of course, the intercalant compound should be capable of being intercalated into the graphite fibers. Additionally, the intercalant should be reducible, for example by exposure to flowing hydrogen gas. While any intercalant meeting the above-stated criteria may be used according to the present invention, the nonmetallic components of the intercalant compound preferably form a vapor upon reduction of the intercalant compound. Thus, upon reduction, the non-metallic components of such an intercalant can exit from the particle if they remained in the particle, they might damage the particle or composites made therefrom, or adversely affect corrosion resistance.

The modified graphite particle, as stated above, should be selected to have its $\mathcal{E}^\circ$ as close to that of the metal as possible. For that reason, the metallic component used will depend upon the metal into which the particles are ultimately incorporated or the metal in contact with the matrix into which they will be incorporated.

For example, a typical use for the present invention is in graphite fiber-reinforced composites in which the matrix metal, or the metal adjacent to the reinforced composite, is aluminum, an aluminum-based alloy (an alloy in which the predominant metal is aluminum), magnesium or a magnesium-based alloy (an alloy in which the predominant metal is magnesium). In these composites, possible metallic components of the intercalant are preferably nickel or copper and the non-metallic component is typically a halide anion, such as chloride.

The method of intercalation is not believed to be critical. Any known method for intercalating graphite fibers should be useful in the present invention. For example, the intercalant may be vaporized and transported to the graphite particles, or the graphite particles may be soaked in an aqueous solution of the intercalant.

The intercalant compound may be reduced by any means which do not destroy the graphite particle. Typically, the intercalant compound is reduced in situ by passing hydrogen gas over the intercalated particle at elevated temperatures commonly used for reduction in hydrogen. It is believed that the intercalant should be reduced to the fullest extent possible, as the continued presence of the non-metallic component may harm the intercalated particle. For example, residual $Cl^-$ in a graphite particle intercalated with reduced $NiCl_2$ may damage fiber properties or adversely affect the corrosion behavior of the adjacent metal.

After intercalation and reduction, the resulting particle is preferably protected from oxidation prior to incorporation into the matrix. While the effect of oxidation upon the intercalated fiber is not fully known, it is believed that oxidation may be detrimental to the properties of the intercalated particles.

Having described the invention, the following examples are given to illustrate specific applications of the invention including the best mode now known to perform the invention. These specific examples are not intended to limit the scope of the invention described in this application.

EXAMPLES

1. Electrochemical Potential Characterization a. Sample Preparation:

Cylindrical samples of natural graphite and a nickel chloride graphite intercalation compound ($NiCl_2$-GIC) were formed from 5 μm powders by cold isostatic pressing at 689 MPa for 10 minutes followed by machining and cutting to a diameter of 11–13 mm and a length of about 5 mm. Both powders were prepared by Intercal Corporation. Based upon surface appearance and the strength of the material after pressing, the density was estimated to be at least 90% that of bulk.

Some of the $NiCl_2$-GIC cylinders were further processed in a slowly flowing hydrogen furnace for 24 hours at 400° C. in order to attempt to reduce the $NiCl_2$ to metallic Ni and HCl. The material after reduction is denoted as r-$NiCl_2$-GIC.

The test surfaces were circular faces polished on 100% cotton fiber paper (Eaton Berkshire parchment bond with a Kokle finish) to a visually smooth, flat finish. All other surfaces were sealed with two coats of glyptol stop-off lacquer prior to immersion in the electrochemical cell. Attachment to the threaded stainless steel electrode holder was via a portal on the curved sample surface, drilled and tapped to the appropriate size. The Al-6061-T6 sample also was a cylinder of similar dimensions polished with 600 grit SiC paper and sealed with glyptol in the same manner as the graphite samples. The test surface areas were determined by photographing the samples and measuring the exposed area with a planimeter. Typically, the test surface area was about 0.4 $cm^2$.

b. Experimental Electrochemical Procedures:

Electrochemical tests were carried out in 0.1N NaCl using a PAR electrochemical cell with a saturated calomel reference electrode (SCE). Solutions were prepared from Fisher certified reagents dissolved in distilled water from a Barnstead still and were deaerated by bubbling with argon gas for at least 12 hours prior to and throughout the duration of the tests.

Potential-time measurements were acquired by monitoring open-circuit potentials for a period of about four hours with a Keithley electrometer and an Elscint strip chart recorder until a steady potential was attained.

c. Results

FIG. 1 shows the potential-time behavior of Al-6061-T6, graphite, $NiCl_2$-GIC, and r-$NiCl_2$-GIC. It can be seen that the open-circuit potential of each sample reaches an equilibrium potential in less than one hour and remains constant for the duration of the test (four hours). Note that it took longer for the r-$NiCl_2$-GIC sample to achieve its equilibrium value and that the potential for this sample is more positive at shorter times. The reason for the different time dependence of the potential for this sample is not understood.

The equilibrium potentials of the Al-6061-T6,graphite, $NiCl_2$-GIC, r-$NiCl_2$-GIC samples are −1.272, 0.160, 0.632 and −0.577 V, respectively. Thus the equilibrium potential of graphite has been shifted by approximately 0.5 V by both treatments, but the two shifts are of opposite sign. The electrochemical potential difference between Al-6061-T6 and graphite is 1.432 V and between Al-6061-T6 and r-$NiCl_2$-GIC is 0,695 V. This treatment reduces the driving force for galvanic corrosion in 0.1N deaerated NaCl by more than 50%.

2. Mass Loss Measurements in Composites a. Composite Formulation

Composite samples, consisting of graphite or r-$NiCl_2$-GIC powder in an aluminum alloy matrix, were also prepared for testing. Because the density of the r-$NiCl_2$-GIC was unknown, a different technique (besides mass fractions) was used in order to produce samples with similar second-phase volume fractions. A quantity of the graphite powder material sufficient to form the desired volume fraction was weighted on a scale. The volume of that quantity of powder was measured and a similar volume r-$NiCl_2$-GIC was measured out. The graphite and r-$NiCl_2$-GIC powders were mixed with Al-6061-T6 powders in separate vee-blender shells until thoroughly mixed. The blended powders were cold isostatically pressed at 90 ksi for 5 minutes to form green compacts. The green compacts were degassed in a vacuum furnace at 400° C. for 15 minutes at less than $1\times10^{-5}$ Torr until evidence of continuing outgassing subsided. The compacts were prepared for hot isostatic pressing by canning them in stainless steel retorts with tantalum slip sheets, evacuating the cans with a mechanical pump, and sealing by means of a seam welder. Hot isostatic pressing was performed at 450° C. for 30 minutes at 15 ksi pressure. The temperatures for degassing and consolidation were kept deliberately low in order to minimize the loss of additional intercalant. The resultant composite samples had a uniform distribution of the second phase and both samples were measured to have second phase volume fractions of 0.10.

b. Mass Loss Testing Protocol

Cylinders approximately 1 cm in diameter and 1 cm tall were machined from each composite. Corrosion behavior was compared by immersion in 0.1N NaCl (not deaerated) for four weeks.

c. Results of Mass Loss Testing

Weight losses for the reduced, intercalated material were almost half as great as that of the untreated material, 0.9622 $mg/cm^2$ and 1.641 $mg/cm^2$, respectively. SEM examination of the corroded specimens revealed morphological differences in the surface layers which formed during the experiment and, in general, showed that the corrosion attack on the r-$NiCl_2$-GIC/Al-6061-T6 sample was far less severe.

Obviously, many modifications and variations of the present invention are possible in light of the above teachings. It is therefore to be understood that, within the scope of the appended claims, the invention may be practiced otherwise than as specifically described.

What is claimed is:

1. A method of producing a metal matrix composite having improved corrosion resistance in an aqueous chloride environment, comprising the steps of:

intercalating an unmodified graphite particle with an intercalant compound comprising a metallic component in oxidized form and a non-metallic component;

reducing said intercalant compound in situ on said particle;

mixing said intercalated particle with a matrix metal having a half-cell potential which is closer to that of said reduced metallic component than to that of the unmodified graphite particle, thus forming a mixture consolidating said mixture to form a metal matrix composite comprising said metal matrix and said intercalated particle;

exposing said metal matrix composite to an aqueous chloride environment.

2. The method of claim 1 wherein said graphite particle is a filament.

3. The method of claim 2, wherein said graphite particle is a fiber.

4. The method of claim 1, wherein said metal matrix comprises aluminum, an aluminum-based alloy, magnesium or a magnesium-based alloy.

5. The method of claim 4, wherein said metallic component of said intercalant compound is nickel.

6. The method of claim 4, wherein the non-metallic component of said intercalant compound becomes a vapor upon reduction of said intercalant compound.

7. The method of claim 6, wherein the intercalant compound is a metal halide.

8. The method of claim 7, wherein the intercalant compound is $NiCl_2$.

9. The method of claim 1, wherein said aqueous chloride environment is seawater.

10. A method of producing a metal matrix composite, comprising the steps of:

intercalating an unmodified graphite particle with $NiCl_2$;

reducing said $NiCl_2$ in situ on said particle;

mixing said intercalated particle with a matrix metal selected from the group consisting of aluminum and an aluminum-based alloy to form a mixture;

consolidating said mixture to form a metal matrix composite in which said matrix metal is diffusion bonded to said intercalated particle;

exposing said metal matrix composite to an aqueous chloride environment.

11. The method of claim 10, wherein said consolidating step comprises hot-pressing.

* * * * *